US006041833A

United States Patent [19]

Suric

[11] Patent Number: 6,041,833

[45] Date of Patent: Mar. 28, 2000

[54] WIRE CLAMPING AND TWISTING DEVICE FOR USE WITH CORDLESS ELECTRIC SCREWDRIVER

[76] Inventor: Marijan Suric, 2018 Jones Rd., Fort Lee, N.J. 07024

[21] Appl. No.: 09/084,572

[22] Filed: May 26, 1998

[51] Int. Cl.[7] ..... B21F 7/00

[52] U.S. Cl. ..... 140/119; 140/115; 140/118; 140/149

[58] Field of Search ..... 140/115, 118, 140/119, 149

[56] References Cited

U.S. PATENT DOCUMENTS

| | | | |
|---|---|---|---|
| 1,453,447 | 5/1923 | Davidson . | |
| 1,845,951 | 2/1932 | Worsham . | |
| 1,951,891 | 3/1934 | Williams | 140/119 |
| 2,297,174 | 9/1942 | Tabb et al. . | |
| 3,026,915 | 3/1962 | Jones et al. . | |
| 3,163,187 | 12/1964 | MacIntosh . | |
| 3,273,605 | 9/1966 | Ferrara, Jr. . | |
| 3,311,139 | 3/1967 | Allen | 140/115 |
| 3,333,609 | 8/1967 | Fielding . | |
| 3,700,009 | 10/1972 | Cushman | 140/111 |
| 3,759,302 | 9/1973 | Attenborough . | |
| 4,160,469 | 7/1979 | Joannic | 140/115 |
| 4,865,086 | 9/1989 | Robinson et al. . | |
| 4,880,038 | 11/1989 | Meinershagen . | |
| 5,004,020 | 4/1991 | Meinershagen . | |
| 5,363,525 | 11/1994 | Andreasen . | |
| 5,379,809 | 1/1995 | Waulk | 140/118 |
| 5,501,251 | 3/1996 | Vader et al. | 140/53 |

*Primary Examiner*—Joseph J. Hail, III
*Assistant Examiner*—William Hong
*Attorney, Agent, or Firm*—Richard M. Goldberg

[57] ABSTRACT

A wire clamping and twisting device includes a base member with a radial projection,; an inner member rotatably held in the base member and having a hexagonal shaft engageable by a cordless electric screwdriver to rotate the shaft in the base member, an inner recess for receiving the distal ends of the wires, a plate insert having a V-shaped recess extending into the inner recess, with walls of the plate insert engaging distal ends of the wires to cause the distal ends to rotate with the inner member and thereby twist the wires, and an outer surface with an annular groove which receives the radial projection of the base member for preventing axial movement of the inner member in the base member, while permitting rotation thereof; and a grasping device mounted to the base member for non-rotatably grasping portions of the wires located proximally from the distal ends of the wires during rotation of the inner member, the grasping device having opposed gripping members for gripping the proximally located portions of the wires, spring members biasing the gripping members away from each other into a non-gripping position, an outer sleeve slidably mounted on the base member and having an inner bore engaging and moving the gripping members toward each other when the outer sleeve is moved forward on the base member, and a pivotal handle for moving the outer sleeve forward on the base member.

18 Claims, 8 Drawing Sheets

WIRE CLAMPING AND TWISTING DEVICE FOR USE WITH CORDLESS ELECTRIC SCREWDRIVER

BACKGROUND OF THE INVENTION

The present invention relates generally to wire clamping and twisting devices, and more particularly, is directed to a wire clamping and twisting device that will clamp two or more electrical wires and then twist the wires together in an intertwined manner.

Conventionally, electricians must twist together two or more wires many times a day, and then insert a wire nut thereover. This is generally accomplished with a pair of pliers. However, these wires can be relatively thick, and twisting multiple sets of wires during the course of a day can be tiresome and time-consuming.

Various wire twisting devices are known. These known wire twisting devices function to grasp the distal ends of the wires at one position thereon and then twist the wires relative to each other by a rotating action of the device. These devices assume that the proximal ends of the wires are held in one position during the twisting operation and do not move around.

This is generally not true when twisting electrical wires. In other words, the electrical wires extend from a wall for a considerable distance, so that the great length of electrical wires are thereby twisted. However, it is generally only necessary to twist the uncovered ends of the wires, that is, the last one to two inches of exposed wires. As a result, the entire wires become unnecessarily twisted together, which increases the time for twisting the exposed, free ends, and does not always perform an adequate twist of the exposed, free ends of the wires.

Examples of such wire twisting devices that grasp the wires only at one position thereon, that is, at the position at which the wires are twisted, and assume that the wires are securely held at another position, for example, by a wall, by wrapping about a device, etc., are described in U.S. Pat. Nos. 1,453,447 to Davidson; 1,845,951 to Worsham; 2,297,174 to Tabb et al; 3,026,915 to Jones et al; 3,163,187 to MacIntosh; 3,273,605 to Ferrara, Jr.; 3,333,609 to Fielding; 3,759,302 to Attenborough; 4,865,086 to Robinson et al; 4,880,038 to Meinershagen; 5,004,020 to Meinershagen; and 5,363,525 to Andreasen.

OBJECTS AND SUMMARY OF THE INVENTION

Accordingly, it is an object of the present invention to provide a wire clamping and twisting device that overcomes the problems with the aforementioned prior art.

It is another object of the present invention to provide a wire clamping and twisting device that non-rotatably clamps the wires close to the free ends thereof, and then separately engages the free ends and twists the wires together only between the free ends and the clamped portion.

It is still another object of the present invention to provide a wire clamping and twisting device that twists only a small portion at the ends of the wires, while leaving the remainder of the wires untwisted.

It is yet another object of the present invention to provide a wire clamping and twisting device that can be used with one hand with a cordless electric screwdriver.

It is a further object of the present invention to provide a wire clamping and twisting device that takes only a few seconds to twist the wires.

It is a yet further object of the present invention to provide a wire clamping and twisting device that is easy and economical to use and make.

In accordance with an aspect of the present invention, a wire clamping and twisting device, includes a base member; an inner member rotatably held in the base member, the inner member having an engagement member engageable by a rotating device to rotate the inner member in the base member, and an assembly for engaging distal ends of wires received in the inner member so as to rotate the wires upon rotation of the inner member and thereby twist the wires; and a grasping device mounted to the base member for non-rotatably grasping portions of the wires located proximally from the distal ends of the wires during rotation of the inner member.

The engagement member includes a shaft having a non-circular cross-section.

The assembly for engaging the distal ends of the wires includes an inner recess in the inner member for receiving the distal ends of the wires; and at least one projection in the inner recess for engaging the distal ends of the wires to cause the distal ends of the wires to rotate with the inner member.

Preferably, the assembly includes a plate insert having a substantially V-shaped recess extending into the inner recess, with walls of the plate insert forming the at least one projection.

In addition, the inner member includes an annular groove in an outer surface thereof, and the base member includes a projection which extends into the annular groove for preventing axial movement of the inner member in the base member, while permitting rotation of the inner member in the base member.

The grasping device includes at least one gripping member for gripping portions of the wires located proximally from the distal ends of the wires; at least one spring member which biases the at least one gripping member into a non-gripping position; and an actuating assembly for moving the at least one gripping member to a gripping position against the force of the at least one spring member in order to grip the wires.

Preferably, there are two opposed gripping members movable toward each other to grip the portions of the wires therebetween, and movable away from each other to release the portions of the wires; and a spring member associated with each gripping member for moving the gripping members away from each other. Each spring member includes a leaf spring having one end secured to the base member and another end secured to one the gripping member.

The actuating assembly includes an outer sleeve slidably mounted on the base member, the outer sleeve having an inner bore with a frusto-conical taper which engages the gripping members so as to move the gripping members toward each other when the outer sleeve is moved forward on the base member; the gripping members have inclined outer surfaces which correspond in inclination to the frusto-conical taper so as to slide thereagainst; an actuating assembly spring member which biases the outer sleeve rearward on the base member; and an actuating member for biasing the outer sleeve forward on the base member against the force of the actuating assembly spring member.

Preferably, the actuating assembly spring member includes a coil spring positioned between the base member and the outer sleeve; the base member includes a projection; and one end of the coil spring is engaged against the projection and an opposite end of the coil spring is engaged against an extension of the outer sleeve. The base member includes an adjustment screw for engaging a rear surface of the outer sleeve to adjust an initial position of the outer sleeve on the base member and an initial tension of the actuating assembly spring member.

Further, the actuating member includes a handle pivotally mounted to the base member, with one end of the handle abutting against a rear end of the outer sleeve, for moving the outer sleeve forward on the base member, against the force of the actuating assembly spring member.

In accordance with another aspect of the present invention, a wire clamping and twisting device, includes a base member including a radial projection; an inner member rotatably held in the base member, the inner member having an engagement member engageable by a rotating device to rotate the inner member in the base member, an inner recess for receiving the distal ends of the wires, at least one projection in the inner recess for engaging the distal ends of the wires to cause the distal ends of the wires to rotate with the inner member and thereby twist the wires, and an annular groove in an outer surface of the inner member thereof which receives the radial projection of the base member for preventing axial movement of the inner member in the base member, while permitting rotation of the inner member in the base member; and a grasping device mounted to the base member for non-rotatably grasping portions of the wires located proximally from the distal ends of the wires during rotation of the inner member, the grasping device having at least one gripping member for gripping portions of the wires located proximally from the distal ends of the wires, at least one spring member which biases the at least one gripping member into a non-gripping position, and an actuating assembly for moving the at least one gripping member to a gripping position against the force of the at least one spring member in order to grip the wires.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
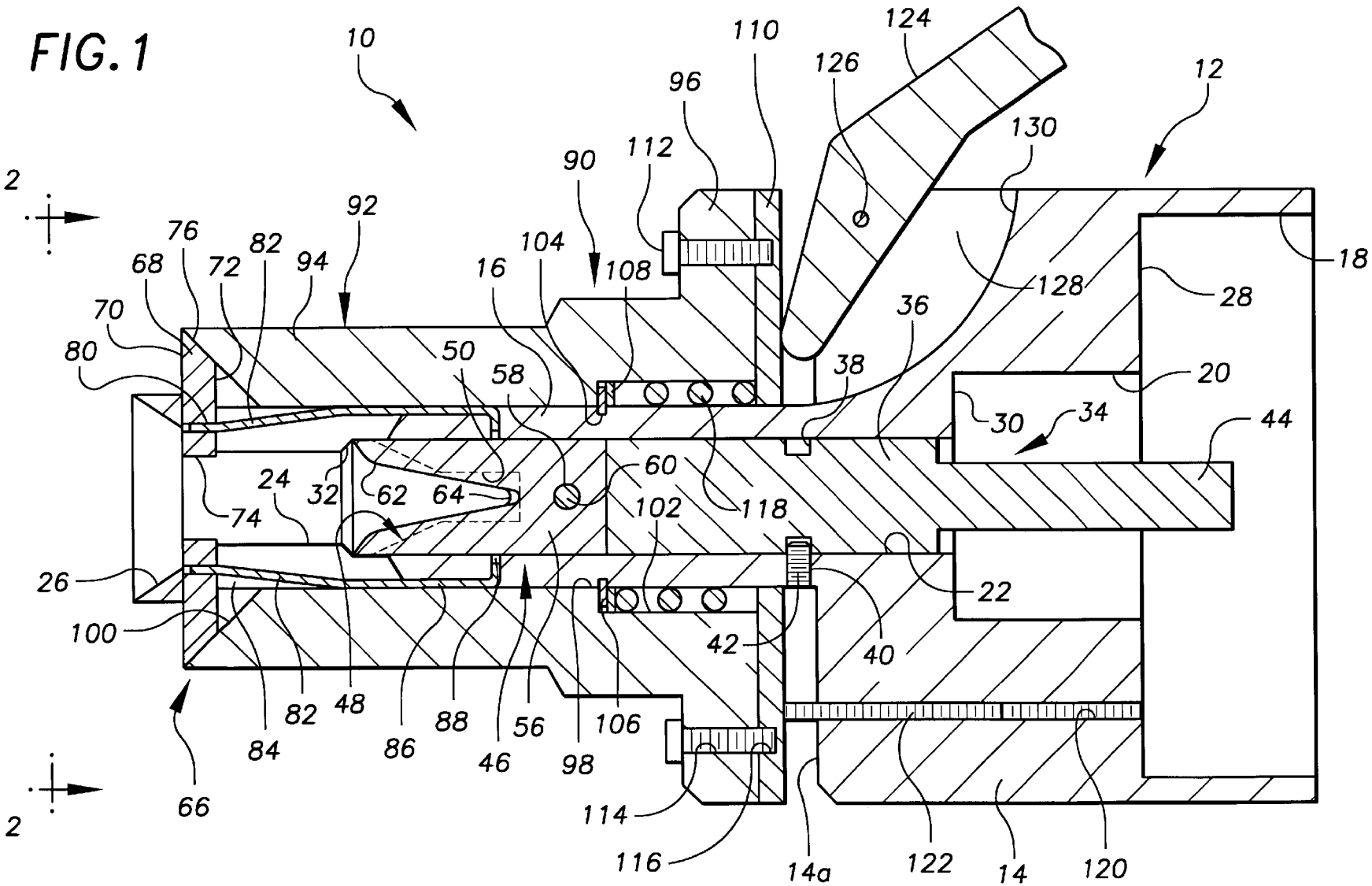
FIG. 1 is a longitudinal cross-sectional view of a wire clamping and twisting device according to the present invention, shown in an open condition.
Figure 2:
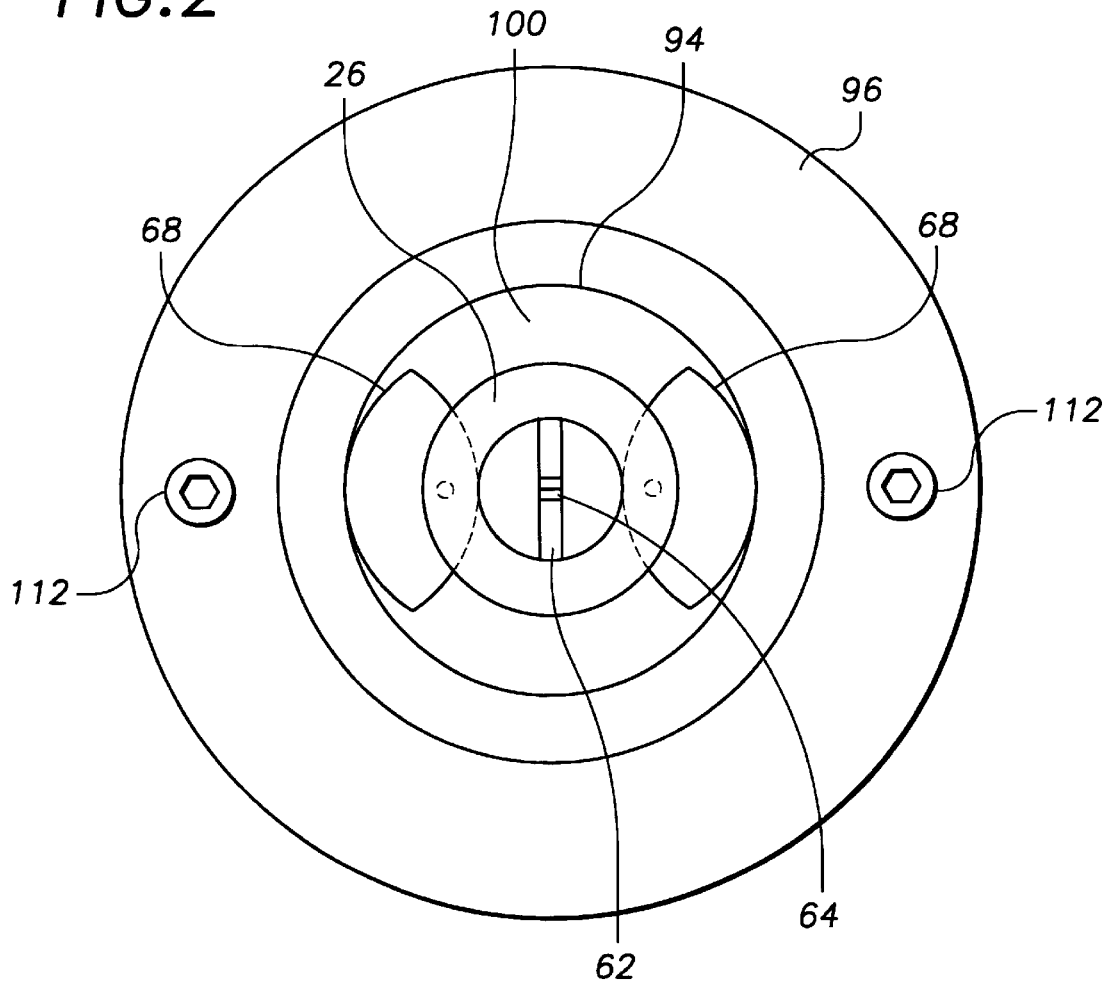
FIG. 2 is a front elevational view of the wire clamping and twisting device of FIG. 1, viewed from line 2—2 thereof.

Referring to the drawings in detail, and initially to FIGS. 1–7 thereof, a wire clamping and twisting device 10 according to the present invention includes a base member 12 having a large diameter cylindrical portion 14 of a substantially constant outer diameter, and which reduces down to a small diameter cylindrical portion 16 having a smaller substantially constant outer diameter. The leftmost end of base member 12 in FIG. 1 is the front or distal end, while the rightmost end of base member 12 in FIG. 1 is the rear or proximal end thereof.

A central, longitudinal bore extends entirely through base member 12, and particularly, includes a first bore 18 at the rear end of cylindrical portion 14, which extends forward for about one-third the length of cylindrical portion 14. A second bore 20 of a lesser diameter than first bore 18 and axially aligned therewith, is in communication with first bore 18, with second bore 20 extending about another one-third of the length of cylindrical portion 14. A third bore 22 of a lesser diameter than second bore 20 and axially aligned therewith, is in communication with second bore 20, with third bore 22 extending from cylindrical portion 14 through the majority of the length of cylindrical portion 16. Third bore 22 tapers down to a fourth bore 24 of a lesser diameter than third bore 22 and axially aligned therewith, and is in communication with third bore 22. Finally, the opposite end of fourth bore 24 ends in a fifth outwardly flared bore 26. With the above arrangement, inner annular shoulders 28, 30 and 32 are formed between bores 18, 20; 20, 22; and 22, 24, respectively.

As shown best in FIGS. 1–4 and 8–10, an inner member 34 is rotatably held in base member 12. Specifically, inner member 34 includes a cylindrical post 36 of a slightly smaller outer diameter than the diameter of third bore 22 so as to rotatably mount therein. Cylindrical post 36 includes a circumferential groove 38, and small diameter cylindrical portion 16 includes a threaded, transverse bore 40 with a set screw 42 threadedly received in transverse bore 40 and extending into circumferential groove 38, when the forward or distal end of cylindrical post 36 is in abutment with annular shoulder 32. In this manner, post 36 is free to rotate within third bore 22, but is axially immovable therein.

Inner member 34 includes an engagement member in the form of an engagement post 44 with an outer, hexagonal cross-section at the rear or proximal end thereof. Engagement post 44 is engageable by a rotating device, such as a cordless electric screwdriver, a drill, etc. to rotate inner member 34 in base member 12. Specifically, first and second bores 18 and 20 are adapted to receive the end of a cordless screwdriver or other similar device, which has a hexagonal recess (not shown) that receives hexagonal engagement post 44 for rotating the same.

The opposite distal end of inner member 34 is formed with an assembly 46 for engaging distal ends of wires received in inner member 34 so as to rotate the wires upon rotation of inner member 34, and thereby twist the wires.

Specifically, assembly 46 first includes an inner, frusto-conical recess 48 at the forward or distal end of inner member 34, with frusto-conical recess 48 terminating in an inner threaded or grooved cylindrical recess 50 located proximally thereof, and in communication with frusto-conical recess 48. An elongated longitudinal slot 52 extends rearwardly from the front or distal end of cylindrical post 36 for a distance of approximately 40% of the length of cylindrical post 36, thereby extending rearwardly or proximally past the closed end of cylindrical recess 50. Longitudinal slot 52 has a width equal to the outer diameter of cylindrical post 36 so that diametrically opposite sides of cylindrical post 36 are open. Further, a transverse threaded bore 54 extends through cylindrical post 36 perpendicular to the plane of longitudinal slot 52 so as to intersect longitudinal slot 52.

Assembly 46 further includes a plate insert 56 having a length and width corresponding to the length and width of longitudinal slot 52. Plate insert 56 also includes a bore 58 near the lower end thereof. Thus, when plate insert 56 is fit within longitudinal slot 52, a set screw 60 is threaded into bore 54 and extends through bore 58 so as to lock plate insert 56 into longitudinal slot 52 of cylindrical post 36. In such case, the front or distal ends of plate insert 56 and cylindrical post 36 are preferably coplanar.

Plate insert 56, as best shown in FIGS. 1, 3 and 12–14, includes a V-shaped recess 62 therein, with the bottom 64 of recess 62 having an inverted V-shape. In this regard, when wires are positioned within bore 24, the distal ends of the wires travel down and seat within cylindrical recess 50 on either side of plate insert 56. The inverted V-shaped bottom 64 prevents the distal ends of the wires from seating within V-shaped recess 62. Therefore, as cylindrical post 36 is rotated, the distal ends of the wires are pushed by the sides of plate insert 56 so as to rotate the wires. The threads or grooves in cylindrical recess 50 also function to somewhat engage the distal ends of the wires so that the wires rotate with cylindrical post 36.

Of course, it will be appreciated that plate insert 56 can be eliminated, and in place thereof, any suitable projection can be placed in cylindrical recess 50 in order to move the distal ends of the wires therein in a twisting manner.

Device 10 further includes a grasping device 66 mounted to base member 12 for non-rotatably grasping portions of the wires located at the forward or distal end of base member 12 during rotation of inner member 34.

Specifically, grasping device 66 includes two opposed gripping members 68 slidably mounted in opposing arcuate transverse bores 69 at the forward or distal end of small diameter cylindrical portion 16 of base member 12, spring members 82 which normally bias gripping members 68 outwardly and apart, and an actuating assembly 90 for moving gripping members 68 toward each other against the force of spring members 82 in order to grip proximal portions of the wires therebetween.

Figure 15:
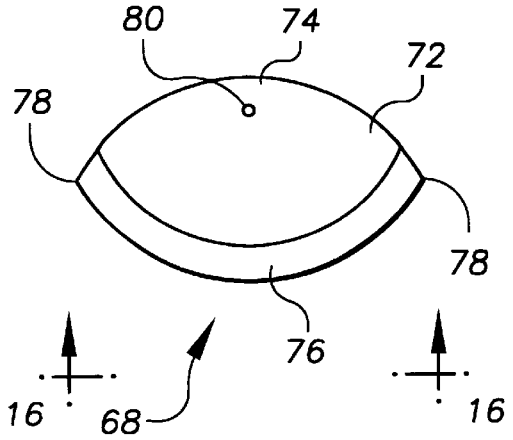
FIG. 15 is a plan view of a gripping member of the clamping and twisting device.
Figure 16:
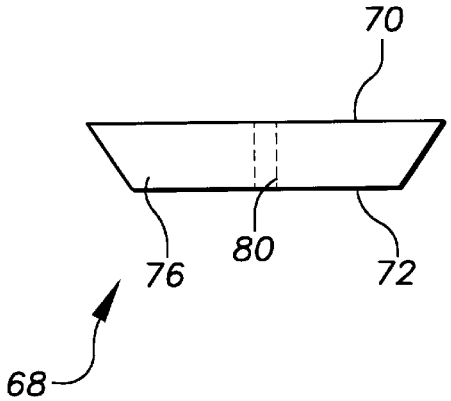
FIG. 16 is an elevational view of the gripping member of FIG. 15, viewed along line 16—16 thereof.

As shown in FIGS. 15 and 16, each gripping member 68 is formed from a plate having opposite front and rear parallel surfaces 70 and 72, and with a somewhat oval shape with pointed ends, that is, with two convex inner and outer side surfaces 74 and 76 that meet at opposite points 78. Inner surfaces 74 can be knurled or roughened for better clamping. As further shown, outer side surface 76 is inwardly inclined from front surface 70 to rear surface 72. In addition, each gripping member 68 includes a small bore 80 that extends through front and rear parallel surfaces 70 and 72 and perpendicular thereto.

Small diameter cylindrical portion 16 includes diametrically opposite slits 84 which communicate with fourth bore 24. At the rear ends of slits 84, there are diametrically opposite, thin, elongated recesses 86 on the outer surface of small diameter cylindrical portion 16. The rear ends of recesses 86 terminate in opposite diametrical small bores 88.

As discussed above, spring members 82 normally bias gripping members 68 outwardly and apart. Specifically, each spring member 82 is a small diameter, elongated leaf spring having one end inserted into a respective bore 80. From bore 80, each leaf spring 82 travels into a slit 84, then into a recess 86, and finally has a bent end that extends into a small bore 88 in order to anchor the leaf spring to small diameter cylindrical portion 16. With this arrangement, spring members 82 are normally biased outwardly, and thereby bias gripping members 68 outwardly.

As discussed above, actuating assembly 90 moves gripping members 68 toward each other against the force of spring members 82 in order to grip the wires therebetween. Specifically, actuating assembly 90 includes a cylindrical outer sleeve 92 slidably mounted on small diameter cylindrical portion 16. Outer sleeve 92 includes a generally cylindrical portion 94 having a proximal or rear annular flange 96. A central bore extends through cylindrical portion 94 and annular flange 96, and has a first bore 98 extending from the distal end of cylindrical portion 94 to a position spaced from annular flange 96, and a second bore 102 in communication with bore 98 and of larger diameter, with second bore 102 extending through annular flange 96 and the rear end of cylindrical portion 94. First bore 98 has an inner diameter slightly greater than the outer diameter of small diameter cylindrical portion 16 to permit sliding movement on small diameter cylindrical portion 16.

The front or distal end of cylindrical portion 94 has an inner frusto-conical surface 100 into which central bore 98 terminates. The angle of inclination of frusto-conical surface 100 is the same as the angle of inclination of outer side surfaces 76 of gripping members 68. As a result, outer side surfaces 76 slide along the inner frusto-conical surface 100 of small diameter cylindrical portion 16. Thus, when outer sleeve 92 slides rearward on small diameter cylindrical portion 16 toward large diameter cylindrical portion 14, as shown in FIG. 1, gripping members 68 move to the larger diameter portion of frusto-conical surface 100 and away from each other. On the other hand, when outer sleeve 92 slides forward on small diameter cylindrical portion 16 away from large diameter cylindrical portion 14, as shown in FIG. 3, gripping members 68 move to the smaller diameter portion of frusto-conical surface 100 and toward each other in order to grip wires extending therebetween.

In order to move outer sleeve 92 to the position shown in FIG. 1, an annular groove 104 is formed in the outer surface of small diameter cylindrical portion 16, and a C-shaped retaining ring 106 is positioned in groove 104. A washer 108 is positioned over small diameter cylindrical portion 16 in abutting relation to the rear face of C-shaped retaining ring 106. In addition, a spring holding washer 110 of the same inner diameter as first bore 98 and the same outer diameter as annular flange 96 is held against the rear face of annular flange 96 by bolts 112 extending through bores 114 in annular flange 96 and threadedly engaged in corresponding threaded bores 116 in spring holding washer 110. A coil spring 118 is held in second bore 102 with one end engaging against washer 108 and the opposite end engaging against spring holding washer 110. Since washer 108 is held fixed by C-shaped retaining ring 106, coil spring 118 functions to normally move outer sleeve 92 to the position shown in FIG. 1, with gripping members 68 separated apart. In order to adjust the force of coil spring 118 and adjust the different end position of outer sleeve 92, a longitudinal threaded bore 120 extends through large diameter cylindrical portion 14 of base member 12, and a set screw 122 is threadedly engaged therein. Set screw 122 extends out through the front or distal end of large diameter cylindrical portion 14 to engage the rear surface of spring holding washer 110, and is adjustable through the rear opening of threaded bore 120.

Figure 3:
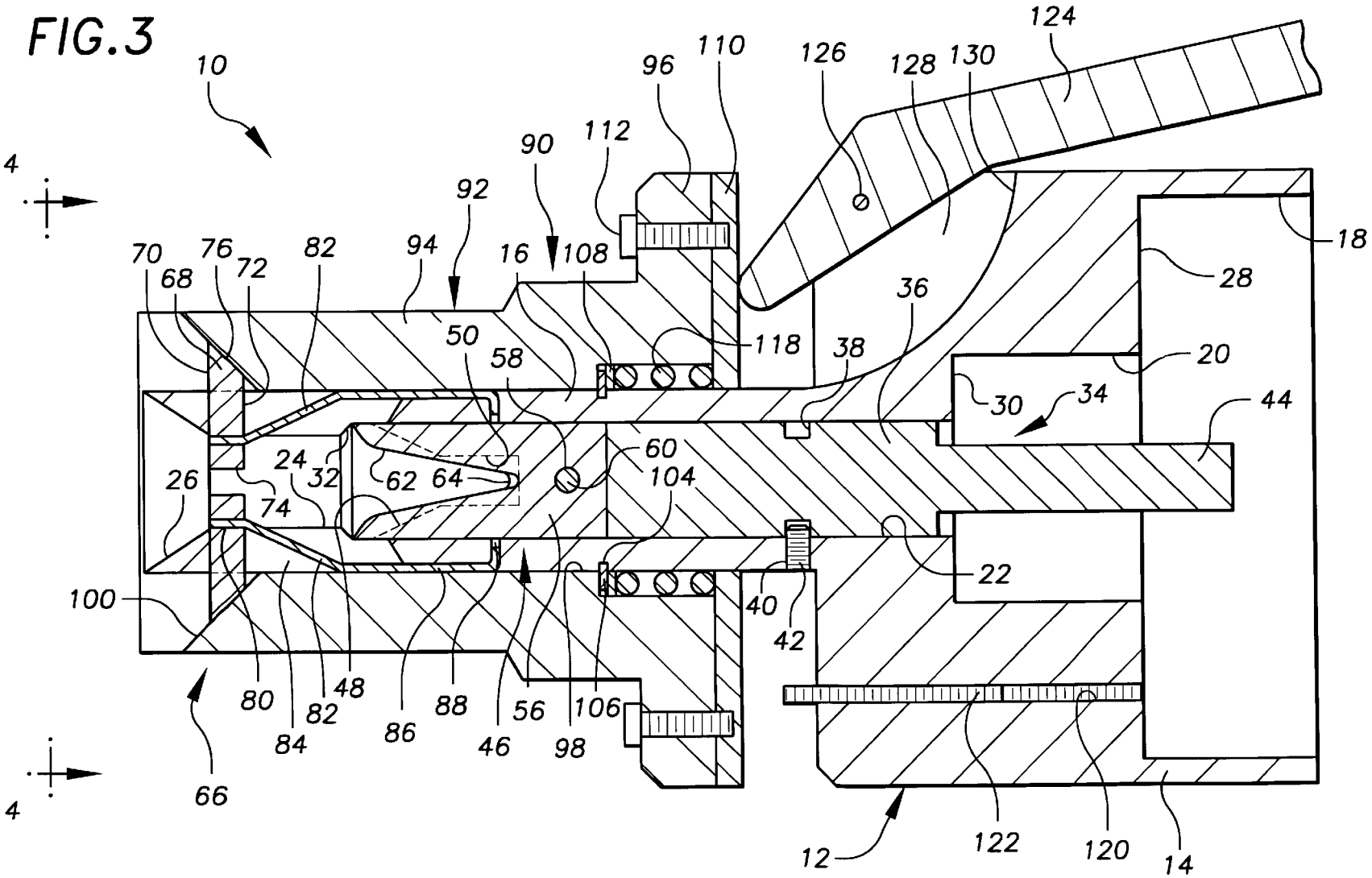
FIG. 3 is a longitudinal cross-sectional view of the wire clamping and twisting device of FIG. 1, shown in a closed condition.
Figure 4:
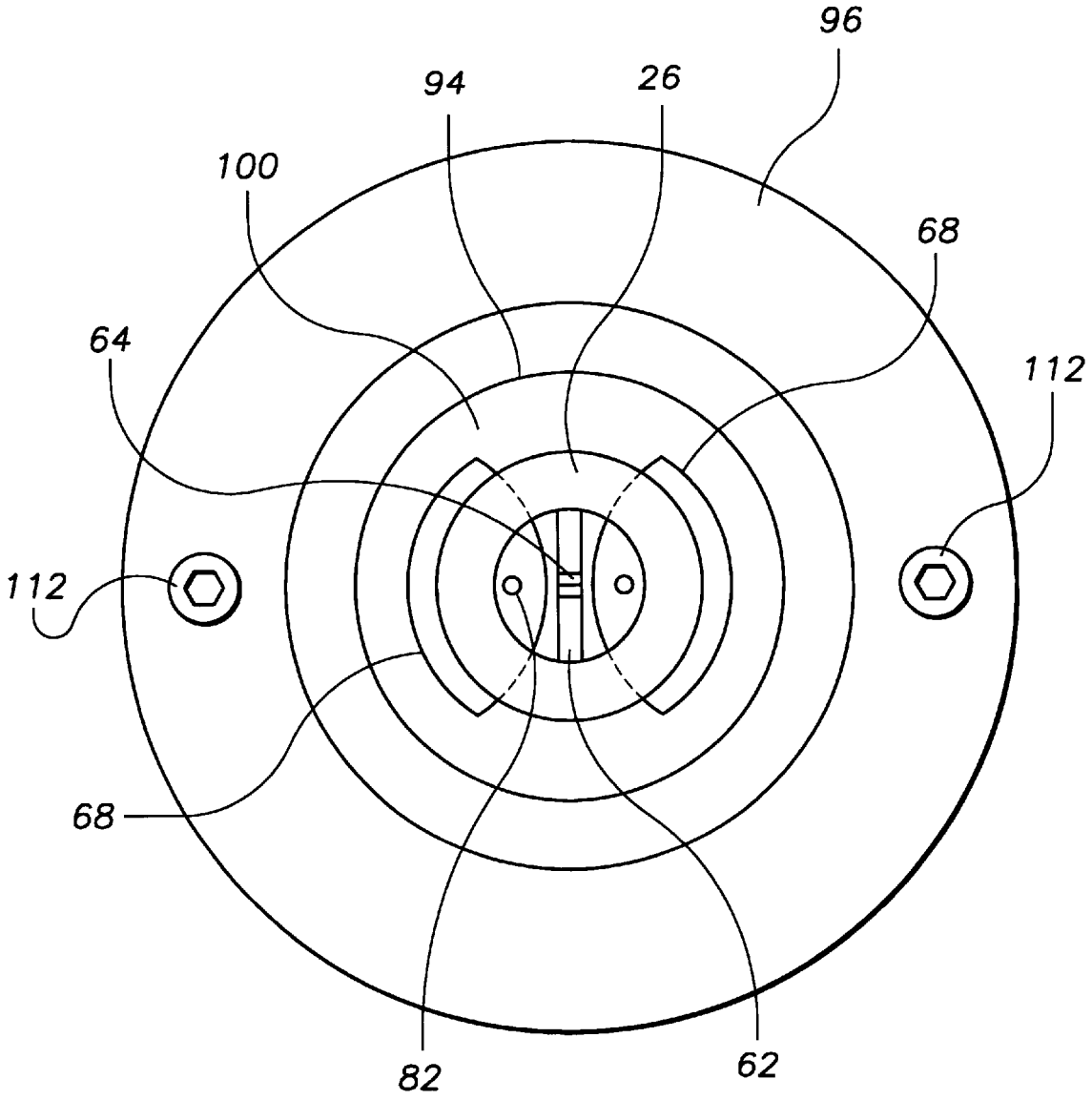
FIG. 4 is a front elevational view of the wire clamping and twisting device of FIG. 2, viewed from line 4—4 thereof.
Figure 5:
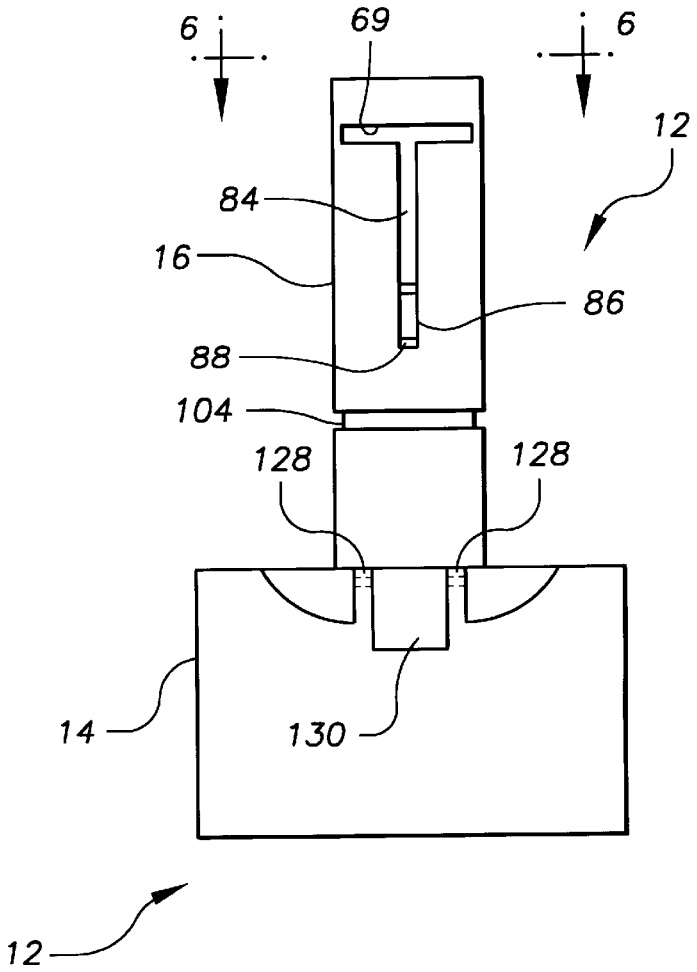
FIG. 5 is a side elevational view of the base member of the wire clamping and twisting device.
Figure 6:
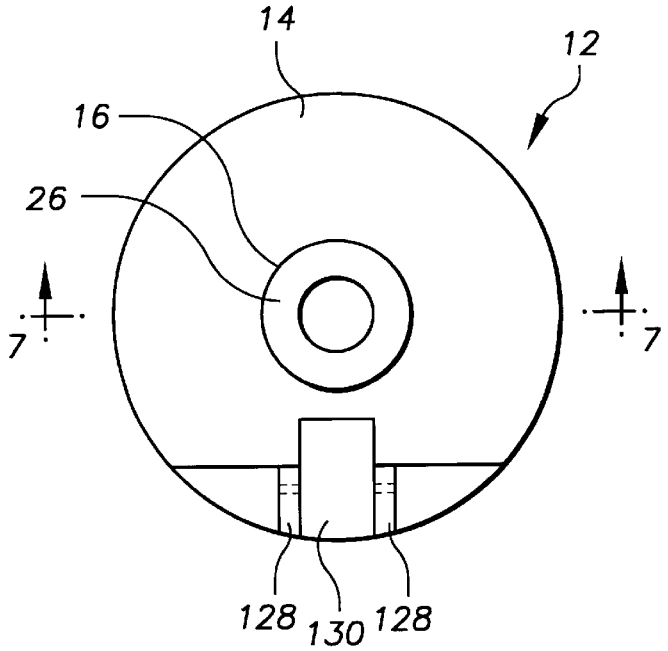
FIG. 6 is a front elevational view of the base member, viewed from line 6—6 thereof.
Figure 7:
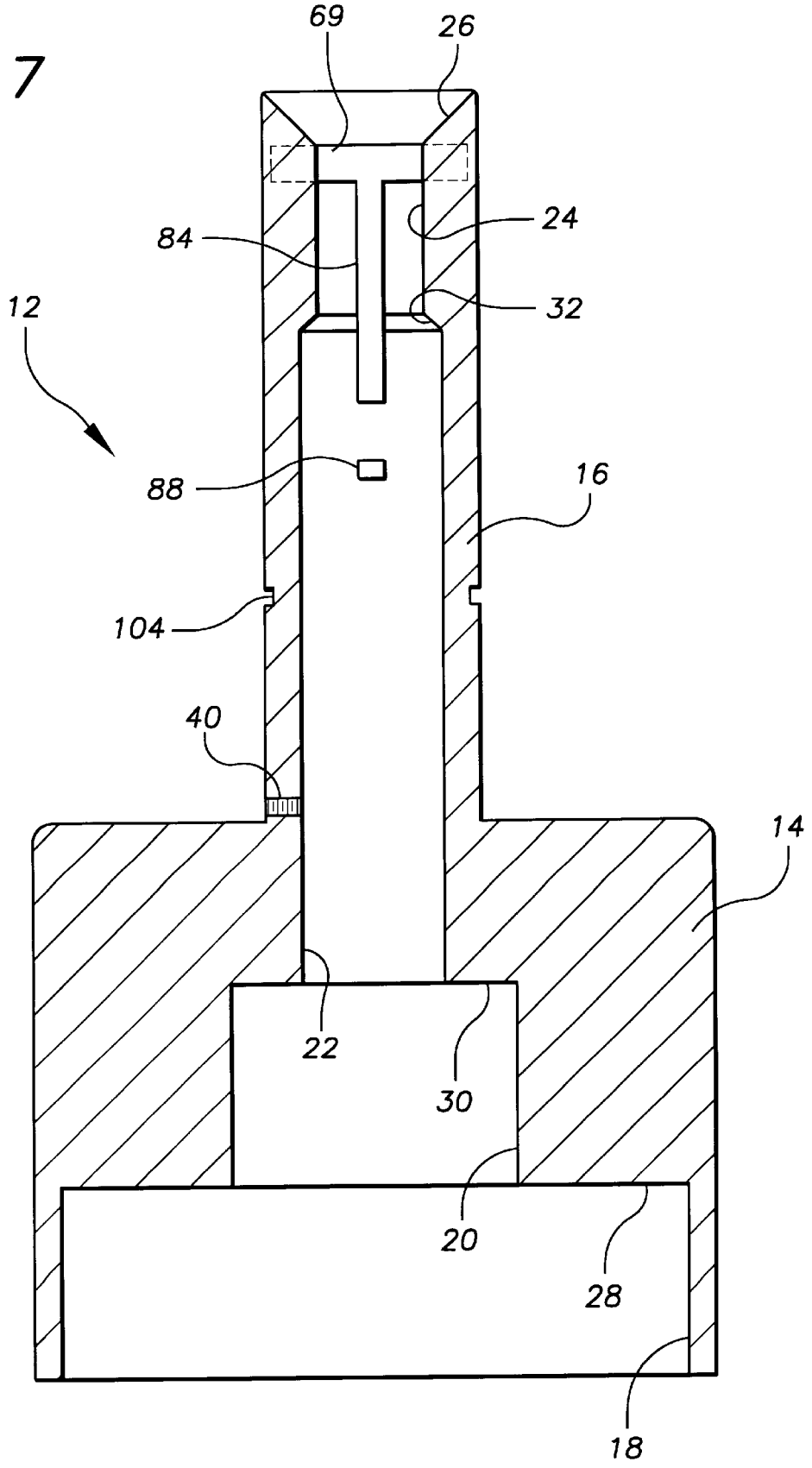
FIG. 7 is a cross-sectional view of the base member of FIG. 6, taken along line 7—7 thereof.
Figure 10:
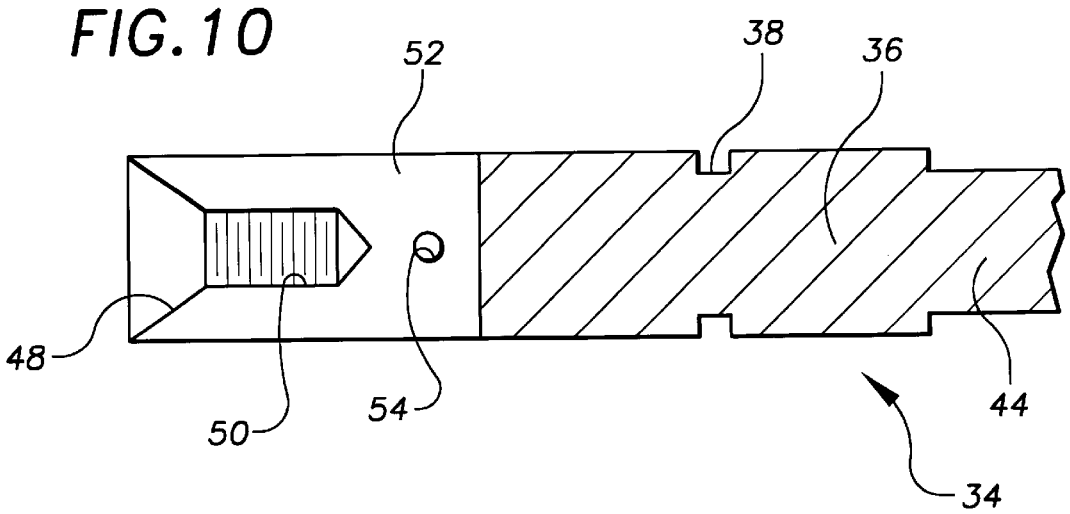
FIG. 10 is a longitudinal cross-sectional view of the inner member of FIG. 8, taken along line 10—10 thereof.
Figure 8:
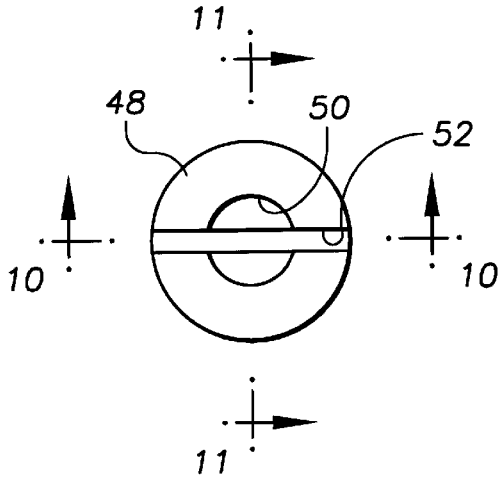
FIG. 8 is a front elevational view of the inner member of the wire clamping and twisting device.
Figure 9:
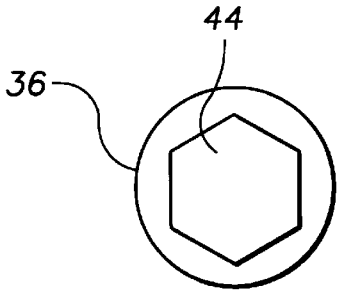
FIG. 9 is a rear elevational view of the inner member.
Figure 11:
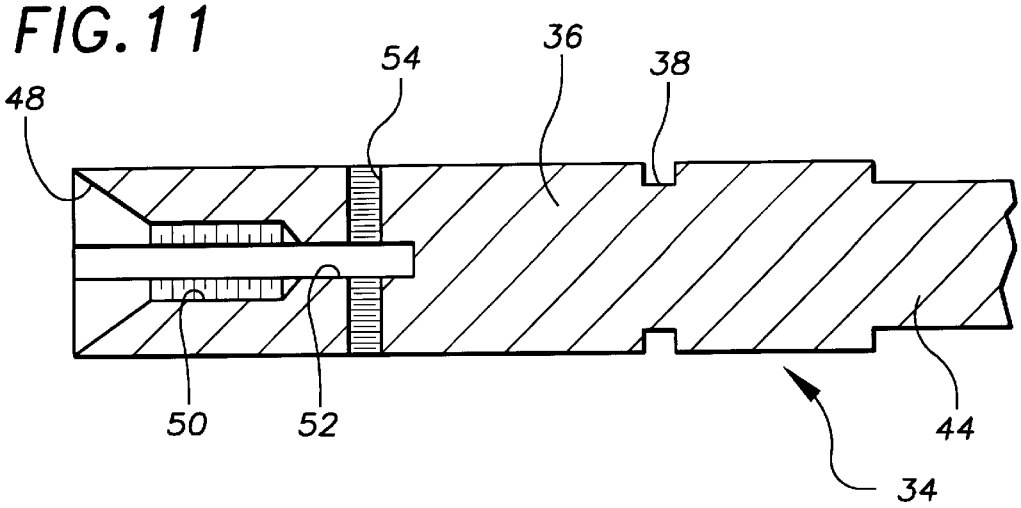
FIG. 11 is a longitudinal cross-sectional view of the inner member of FIG. 8, taken along line 11—11 thereof.
Figure 12:
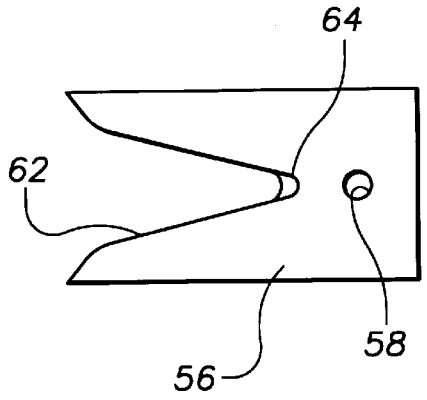
FIG. 12 is a side elevational view of the plate insert of the wire clamping and twisting device.
Figure 13:
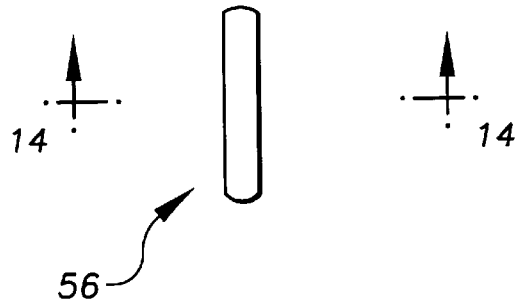
FIG. 13 is a plan view of the plate insert.
Figure 14:
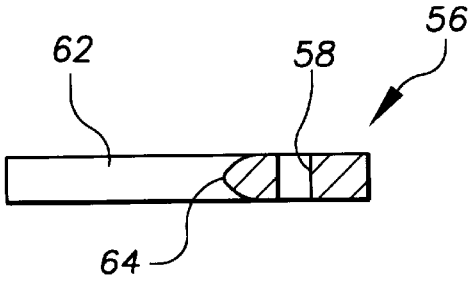
FIG. 14 is a longitudinal cross-sectional view of the plate insert of FIG. 13, taken along line 14—14 thereof.

In order to move outer sleeve 92 to the position shown in FIG. 3, a handle 124 is pivotally mounted by a pivot pin 126 to larger diameter cylindrical portion 14, with one end of handle 124 engaging the rear surface of spring holding washer 110. In this regard, as shown best in FIGS. 1, 5 and 6, the front and side outer circumferential surface of large diameter cylindrical portion 14 is cut away to define two spaced apart walls 128 with a concave or similar wall surface 130 therebetween. The forward end of handle 124 is pivotally mounted between walls 128 by pivot pin 126, which is mounted to walls 128. When handle 124 is moved in the clockwise direction of FIG. 1, the forward end thereof pivots about pivot pin 126 and moves outer sleeve 92 forward to the position shown in FIG. 3. At this time, outer side surfaces 76 of gripping members 68 slide along the inner frusto-conical surface 100 of outer sleeve 92, and thereby move inwardly toward each other so as to grip proximal portions of the wires inserted therebetween. In such case, the proximal portions of the wires held between inner side surfaces 74 of gripping members 68 are non-rotatably held.

In this condition, and with the free ends of the wires extending into cylindrical recess 50 adjacent to plate insert 56, inner member 34 is rotated by, for example, a cordless screwdriver. As such, the free ends of the wires are rotated, while the portions held by gripping members 68 are not rotated. This means that only the exposed ends of the wires are rotated in a short period of time.

Having described a specific preferred embodiment of the invention with reference to the accompanying drawings, it will be appreciated that the present invention is not limited to that precise embodiment, and that various changes and modifications can be effected therein by one of ordinary skill in the art without departing from the scope or spirit of the invention as defined by the appended claims.

What is claimed is:

1. A wire clamping and twisting device, comprising:

a base member;

an inner member rotatably held in said base member, said inner member including:

an engagement member engageable by a rotating device to rotate said inner member in said base member, and an assembly for engaging distal ends of wires received in said inner member so as to rotate the wires upon rotation of said inner member and thereby twist said wires; and a grasping device mounted to said base member for non-rotatably grasping portions of the wires located proximally from the distal ends of the wires during rotation of said inner member, said grasping device including:

at least one gripping member for gripping the portions of the wires located proximally from the distal ends of the wires;

at least one leaf spring member which biases the at least one gripping member into a non-gripping position; and an actuating assembly for moving the at least one gripping member to a gripping position against the force of the at least one spring member in order to grip the wires, said actuating assembly including:

an outer sleeve slidably mounted on said base member, said outer sleeve having an inner bore, at least a portion of which has an inclined taper which engages said at least one gripping member so as to move said at least one gripping member inwardly when said outer sleeve is moved forward on said base member; and an actuating arrangement which engages said outer sleeve and serves to move said outer sleeve forward and rearward on said base member.

2. A wire clamping and twisting device according to claim 1, wherein said engagement member includes a shaft having a non-circular cross-section.

3. A wire clamping and twisting device according to claim 1, wherein said assembly for engaging distal ends includes:

an inner recess in said inner member for receiving the distal ends of the wires; and at least one projection in the inner recess for engaging the distal ends of the wires to cause the distal ends of the wires to rotate with said inner member.

4. A wire clamping and twisting device according to claim 3, wherein said assembly for engaging distal ends includes a plate insert having a substantially V-shaped recess extending into said inner recess, with walls of said plate insert forming said at least one projection.

5. A wire clamping and twisting device according to claim 1, wherein said inner member includes an annular groove in an outer surface thereof, and said base member includes a projection which extends into said annular groove for preventing axial movement of said inner member in said base member, while permitting rotation of said inner member in said base member.

6. A wire clamping and twisting device according to claim 1, wherein:

said taper of said inner bore is a frusto-conical taper;

each said gripping member has an inclined outer surface which corresponds in inclination to said frusto-conical taper so as to slide thereagainst; and said actuating arrangement includes:

an actuating assembly spring member which biases said outer sleeve rearward on said base member; and an actuating member for biasing said outer sleeve forward on said base member against the force of said actuating assembly spring member.

7. A wire clamping and twisting device according to claim 6, wherein:

said actuating assembly spring member includes a coil spring positioned between said base member and said outer sleeve;

said base member includes a projection; and one end of said coil spring being engaged against said projection and an opposite end of said coil spring being engaged against an extension of said outer sleeve.

8. A wire clamping and twisting device according to claim 6, wherein said actuating member includes a handle pivotally mounted to said base member, with one end of said handle abutting against a rear end of said outer sleeve, for moving said outer sleeve forward on said base member, against the force of said actuating assembly spring member.

9. A wire clamping and twisting device according to claim 6, wherein said base member includes an adjustment screw for engaging a rear surface of said outer sleeve to adjust an initial position of said outer sleeve on said base member and an initial tension of said actuating assembly spring member.

10. A wire clamping and twisting device, comprising:

a base member;

an inner member rotatable held in said base member, said inner member including:

an engagement member engageable by a rotating device to rotate said inner member in said base member, and an assembly for engaging distal ends of wires received in said inner member so as to rotate the wires upon rotation of said inner member and thereby twist said wires; and a grasping device mounted to said base member for non-rotatably grasping portions of the wires located proximally from the distal ends of the wires during rotation of said inner member, said grasping device including:

two opposed gripping members movable toward each other to grip the portions of the wires located proximally from the distal ends of the wires therebetween, and movable away from each other to release the portions of the wires;

a spring member associated with each gripping member for moving the gripping members away from each other into a non-gripping position; and an actuating assembly for moving the at least one gripping member to a gripping position against the force of the at least one spring member in order to grip the wires.

11. A wire clamping and twisting device according to claim 10, wherein each said spring member includes a leaf spring having one end secured to said base member and another end secured to one said gripping member.

12. A wire clamping and twisting device, comprising:

a base member including a radial projection;

an inner member rotatably held in said base member, said inner member including:

an engagement member engageable by a rotating device to rotate said inner member in said base member, an inner recess in said inner member for receiving he distal ends of the wires, at least one projection in the inner recess for engaging the distal ends of the wires to cause the distal ends of the wires to rotate with said inner member and thereby twist said wires, and an annular groove in an outer surface of said inner member which receives the radial projection of said base member for preventing axial movement of said inner member in said base member, while permitting rotation of said inner member in said base member; and a grasping device mounted to said base member for non-rotatably grasping portions of the wires located proximally from the distal ends of the wires during rotation of said inner member, said grasping device including:

at least one gripping member for gripping portions of the wires located proximally from the distal ends of the wires, said at least one gripping member including two opposed gripping members movable toward each other to grip the portions of the wires therebetween, and movable away from each other to release the portions of the wires.

at least one spring member which biases the at least one gripping member into a non-gripping position, the at least one spring member including a spring member associated with each gripping member for moving the gripping members away from each other, and an actuating assembly for moving the at least one gripping member to a gripping position against the force of the at least one spring member in order to grip the wires.

13. A wire clamping and twisting device according to claim 12, wherein said engagement member includes a shaft having a non-circular cross-section.

14. A wire clamping and twisting device according to claim 12, wherein said inner member includes a plate insert having a substantially V-shaped recess extending into said inner recess, with walls of said plate insert forming said at least one projection.

15. A wire clamping and twisting device according to claim 12, wherein each said spring member includes a leaf spring having one end secured to said base member and another end secured to one said gripping member.

16. A wire clamping and twisting device according to claim 12, wherein said actuating assembly includes:

an outer sleeve slidably mounted on said base member, said outer sleeve having an inner bore with a frusto-conical taper which engages said gripping members so as to move said gripping members toward each other when said outer sleeve is moved forward on said base member;

said gripping members have inclined outer surfaces which correspond in inclination to said frusto-conical taper so as to slide thereagainst;

an actuating assembly spring member which biases said outer sleeve rearward on said base member; and an actuating member for biasing said outer sleeve forward on said base member against the force of said actuating assembly spring member.

17. A wire clamping and twisting device according to claim 16, wherein:

said actuating assembly spring member includes a coil spring positioned between said base member and said outer sleeve;

said base member includes a projection; and one end of said coil spring being engaged against said projection and an opposite end of said coil spring being engaged against an extension of said outer sleeve.

18. A wire clamping and twisting device according to claim 16, wherein said actuating member includes a handle pivotally mounted to said base member, with one end of said handle abutting against a rear end of said outer sleeve, for moving said outer sleeve forward on said base member, against the force of said actuating assembly spring member.

* * * * *

UNITED STATES PATENT AND TRADEMARK OFFICE

CERTIFICATE OF CORRECTION

PATENT NO : 6,041,833

DATED : March 28, 2000

INVENTOR(S) : Marijan SURIC

It is certified that error appears in the above-identified patent and that said Letters Patent is hereby corrected as shown below:

Column 7, line 64, after "position" insert -- with said leaf spring member corresponding with the at least one gripping member --.

Column 9, line 3, change "rotatable" to -- rotatably --.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*